US005709046A

United States Patent [19]

Canaday

[11] Patent Number: 5,709,046

[45] Date of Patent: Jan. 20, 1998

[54] SINGLE TRIGGER DUAL FIRING MECHANISM

[75] Inventor: Michael M. Canaday, King George, Va.

[73] Assignee: The United States of America as represented by the Secretary of the Navy, Washington, D.C.

[21] Appl. No.: 514,883

[22] Filed: Aug. 14, 1995

[51] Int. Cl.[6] ..... F41A 19/21

[52] U.S. Cl. ..... 42/69.01; 42/69.03; 42/42.01

[58] Field of Search ..... 42/69.01, 69.02, 42/69.03, 42.01, 42.03, 105; 89/127

[56] References Cited

U.S. PATENT DOCUMENTS

| | | | |
|---|---|---|---|
| 1,302,909 | 5/1919 | Giddings | 42/41 |
| 2,095,525 | 10/1937 | Mariano | 42/42.01 |
| 2,409,939 | 10/1946 | Jenkinson | 42/42.01 |
| 2,568,556 | 9/1951 | Morrone | 42/42.01 |
| 2,573,839 | 11/1951 | Garrison | 42/42.01 |
| 3,010,369 | 11/1961 | Musser et al. | 89/27.11 |
| 3,442,173 | 5/1969 | Muller | 89/127 |
| 3,808,724 | 5/1974 | Linde | 42/42.01 |
| 3,950,875 | 4/1976 | Hirschfeld | 42/42.01 |
| 4,091,556 | 5/1978 | Katsenes | 42/42.01 |
| 4,310,981 | 1/1982 | Waddell | 42/42.01 |
| 4,318,329 | 3/1982 | Rentzsch et al. | 89/1.816 |
| 4,472,899 | 9/1984 | Joelsson et al. | 42/42.01 |
| 4,867,039 | 9/1989 | Dobbins | 89/127 |

*Primary Examiner*—Michael J. Carone
*Assistant Examiner*—Matthew J. Lattig
*Attorney, Agent, or Firm*—James B. Bechtel, Esq.

[57] ABSTRACT

A single trigger dual firing mechanism having dual sears and dual hammers is provided. A pivoting connector link is mounted on a trigger with a horizontal pin. A selector bar causes the connector link to rotate to either engage the primary or secondary sear. Engagement of one sear locks the other sear and locks out the opposite hammer. When the selector turns and engages the primary sear then that sear is moved and the primary sear allows the primary hammer to fall. With the selector knob in the opposite position, the secondary sear is operated allowing the secondary hammer to move. The primary hammer is a swing type hammer. The secondary hammer is a piston type hammer. Both hammers operate from a single trigger using a thumb operatable selector bar.

6 Claims, 6 Drawing Sheets

SINGLE TRIGGER DUAL FIRING MECHANISM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates to trigger assemblies or firing mechanisms for large caliber weapons equipped with spotting or range finding smaller caliber guns. The invention specifically relates to single trigger dual firing mechanisms requiring both a spotting rifle and a main weapon.

BACKGROUND OF THE INVENTION

There are numerous multi-trigger or single trigger multi-barrel firing devices available. Typically, many of these devices relate to handguns and shotguns. It is desirable in a handheld rocket launcher/spotter rifle combination that both the main charge and the spotter rifle be fired by the same trigger using the same hand grips and weapon holding fixtures. The construction of current rocket launchers using spotting rifles requires that the spotting rifle be fired using a throw type hammer while the rocket launcher requires a piston or plunger style hammer. The common firing mechanism capable of operating both types of hammers is desirable in weapons equipped with spotting or range finding guns. The firing mechanism should permit the gunner to select either weapon with minimal effort. What is needed is a single trigger operated double sear device, one sear operating a rotating hammer the other operating a sliding piston hammer. Typically, the desired mechanism should have a thumb selectable lever or control, thereby allowing the gunner to depress the control to change the function of the trigger from spotting rifle to main weapon.

SUMMARY OF THE INVENTION

Accordingly, it is an object of the invention to provide a firing mechanism having one trigger which can be used to fire either the main round or the spotting round.

It is a further object of the invention to have a selectable firing mechanism for firing either main round or spotting round which is selected by pressing a selector level.

It is another object of the invention to provide a firing mechanism having a single trigger operating both a rotating throw type hammer and a sliding piston-type hammer.

It is yet another object of the invention to provide a firing mechanism which safes the weapon and prevents further firing once the rocket round is expended.

The invention comprises a single trigger, dual firing mechanism having dual sears and dual hammers. The mechanism has a pivoting connector link, pivoted on the trigger with a horizontal pin. A selector bar causes the connector link to rotate to engage either the primary or secondary sear. Engagement of one sear locks the other sear and locks out the opposite hammer. When the selector is turned to engage the primary sear, the trigger moves the primary sear and allows the primary hammer to fall. When the selector knob is in the opposite position, the secondary sear is operated allowing the secondary hammer to move. The primary hammer is a rotating type hammer. The secondary hammer is a piston type hammer.

BRIEF DESCRIPTION OF THE DRAWINGS

The foregoing and other objects and advantages of the present invention will be more fully understood from the following detailed description and reference to the appended drawings wherein.

DETAILED DESCRIPTION OF THE INVENTION

Figure 1:
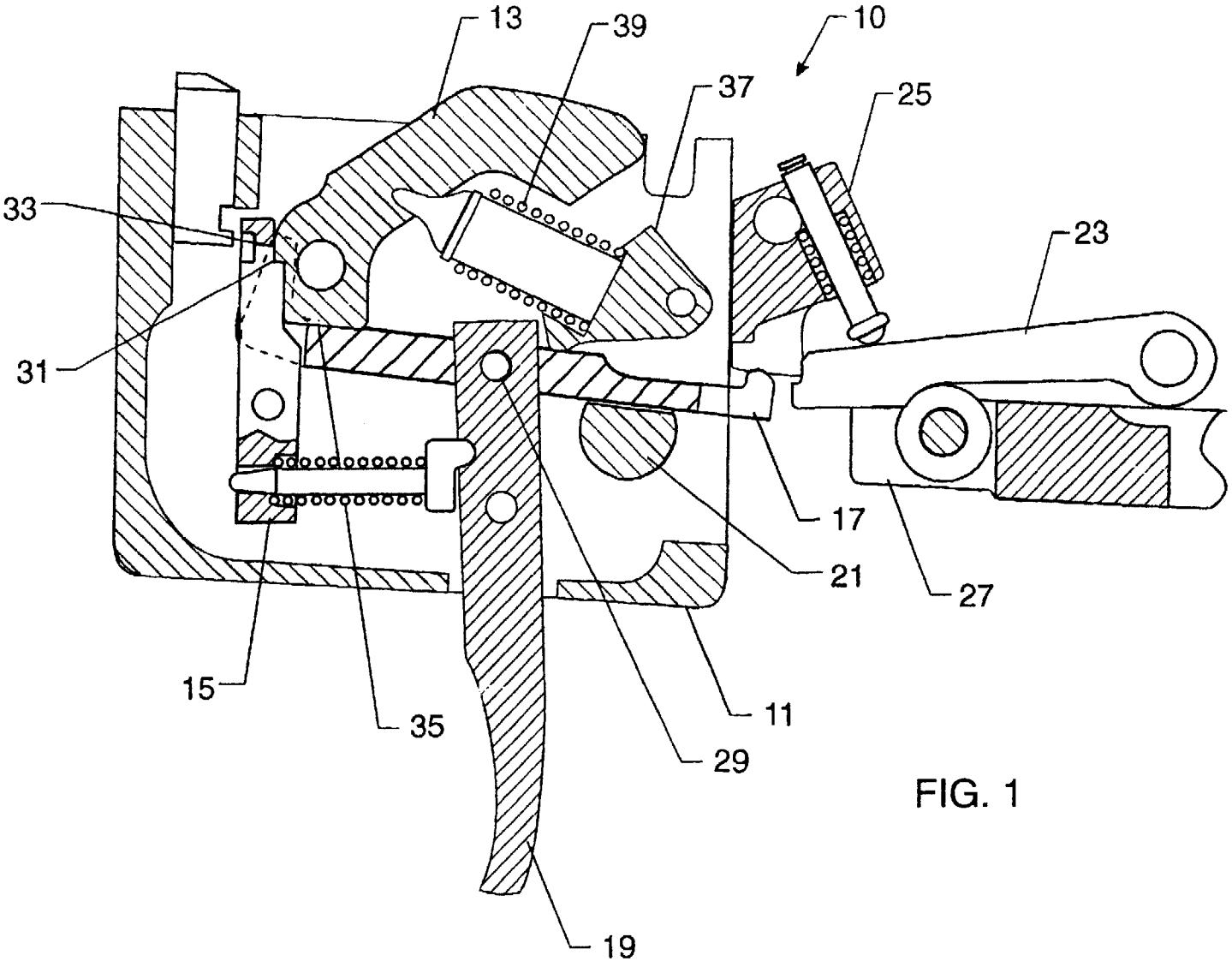
FIG. 1 shows the dual firing mechanism with the primary sear engaging the connector link.

Referring now to FIG. 1, the overall combination of the single trigger dual firing mechanism, designated generally by the reference numeral 10 is shown with its major components. The dual firing mechanism is mounted inside frame 11 which encloses the primary hammer 13, primary sear 15, a connector link 17 which is attached to trigger 19. A selector bar 21, which by rotating an eccentric cam section, adjusts the connector link for engagement of either the primary sear 15 or the secondary sear 23. The secondary sear prop 25, secondary sear 23, and the secondary hammer 27 are all housed outside frame 11 in the stock (shown in FIG. 2) of the weapon, typically a spotting rifle. A key element of this invention is the pivoting connector link 17. The connector link 17 is pivotably mounted on the trigger by a horizontal pin 29. The primary sear 15 prevents the primary hammer 13 from rotating in a counterclockwise direction by catching the hammer on the lug 31. As the trigger 19 is pulled, connector link 17 slides into contact with a lug 33 on the primary sear 15. The connector link 17 is forced into contact with the lower surface of the primary hammer at point 35 by the action of the connector link spring lever 37. Spring lever 37 is forced to rotate in a counterclockwise direction by the primary hammer spring 39. After contact between the connector link and the primary sear 15 is made at lug 33 further application of pressure to the trigger 19 will cause the sear to move counterclockwise out of contact with the primary hammer 13, allowing operation of the hammer. As depicted, the primary hammer 13 is a rotating type hammer of conventional design.

Figure 2:
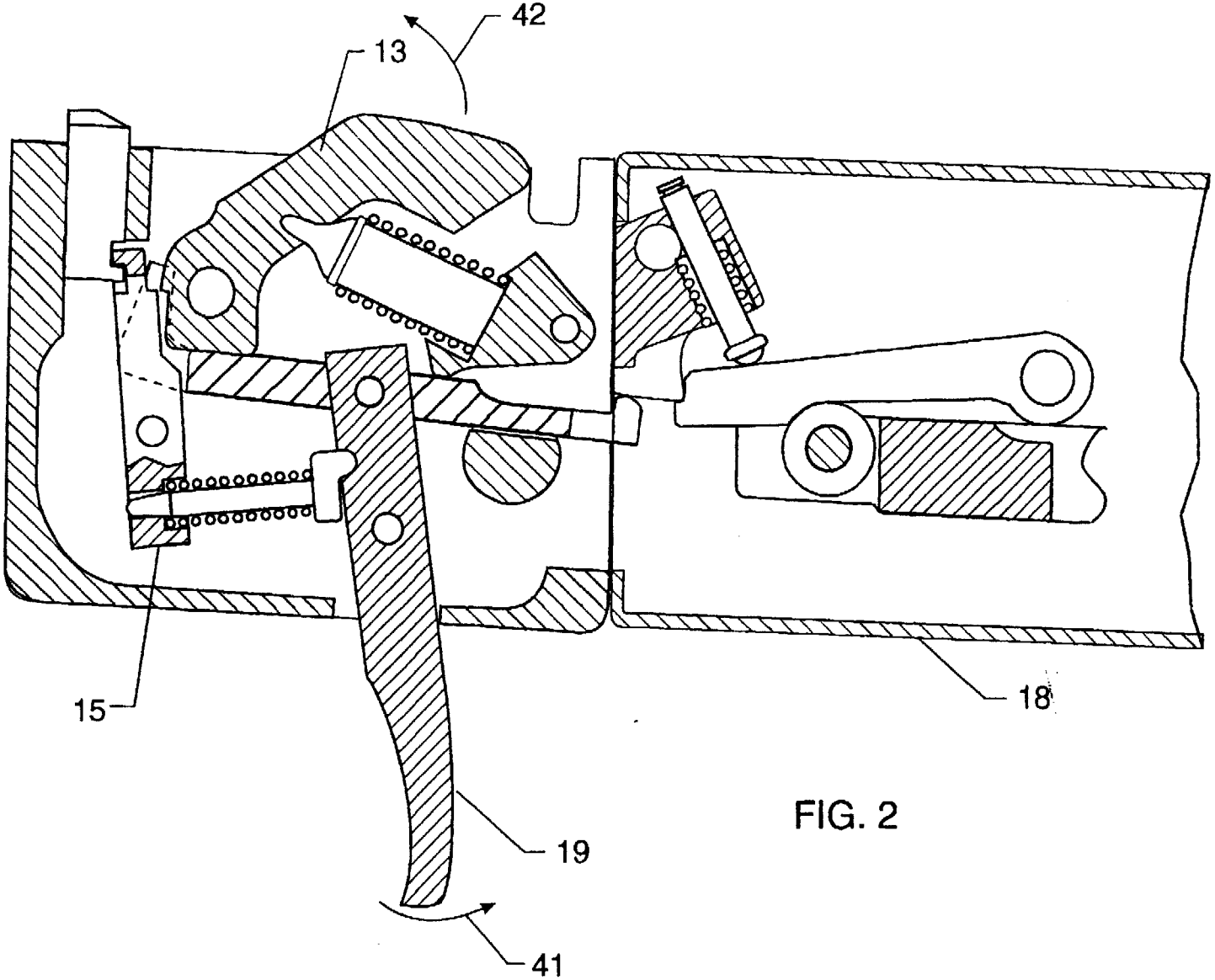
FIG. 2 shows the operation of the primary sear.

Referring now to FIG. 2, operation of the primary hammer can be seen. As trigger 19 is depressed, as depicted by arrow 41, sear 15 moves out of contact with the primary hammer 13 which begins to rotate in a counterclockwise direction as shown by arrow 42. For reference, the stock 18 of the spotter rifle is shown mounting the secondary firing mechanism.

Figure 3:
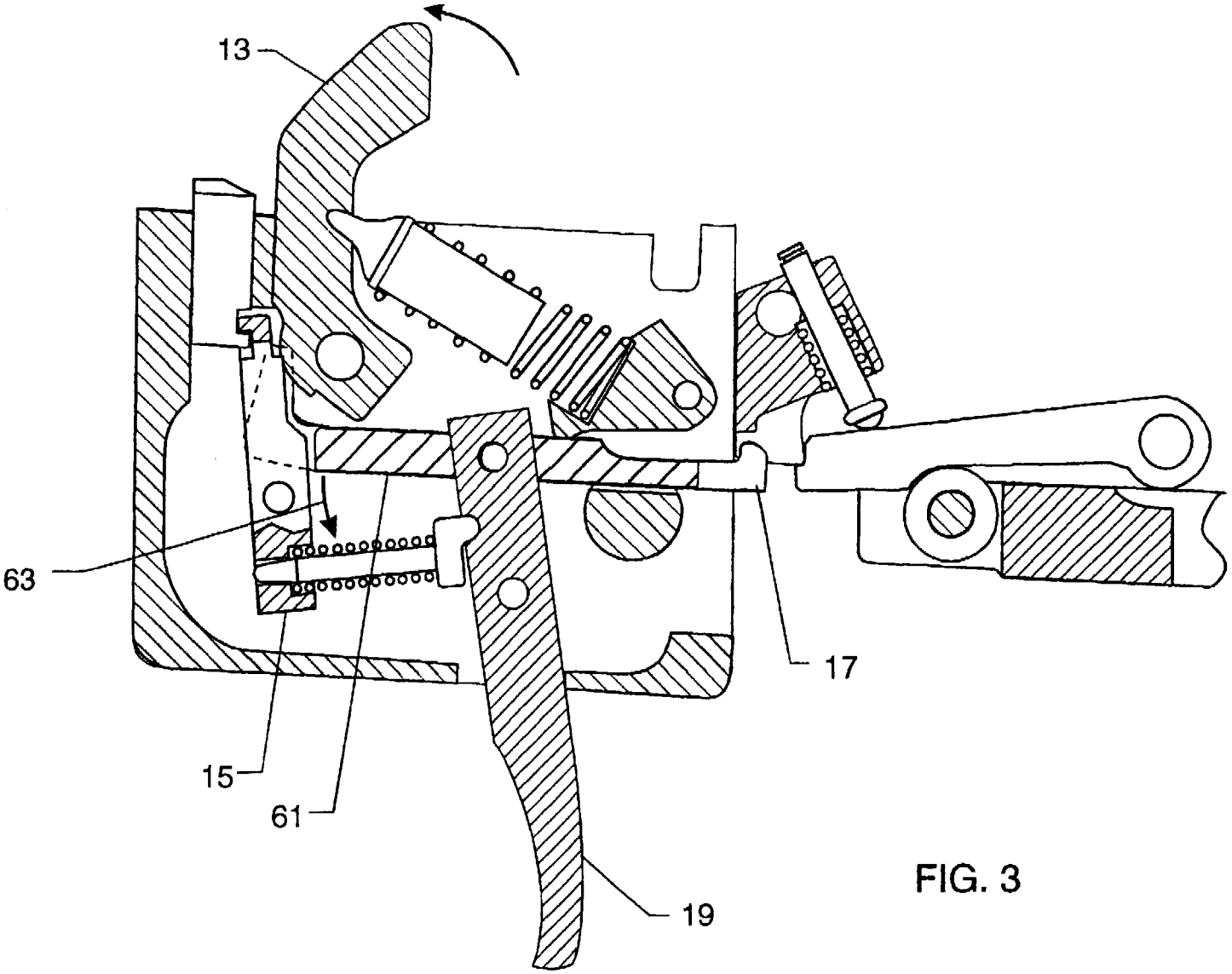
FIG. 3 shows the primary hammer in the fully extended position.

Further operation of the primary hammer may be seen by referring to FIG. 3. In this figure, after the complete travel of trigger 19 the primary hammer 13 is in a fully extended position. The disconnector action of the pivoting connector link 17 is shown in this view where the tip 61 of the primary hammer 13 has caused the pivoting connector link to move in a downward direction as shown by arrow 63. In this position, the connector link 17 is no longer in contact with the primary sear 15. The sear 15 cannot rotate clockwise under the pressure of its spring (to re-engage the notch on the primary hammer) until the hammer is recocked. In order for the connector to come in contact with the sear, force must be removed from the trigger. Releasing the trigger allows the connector link to move rearward and reengage the sear.

Figure 4:
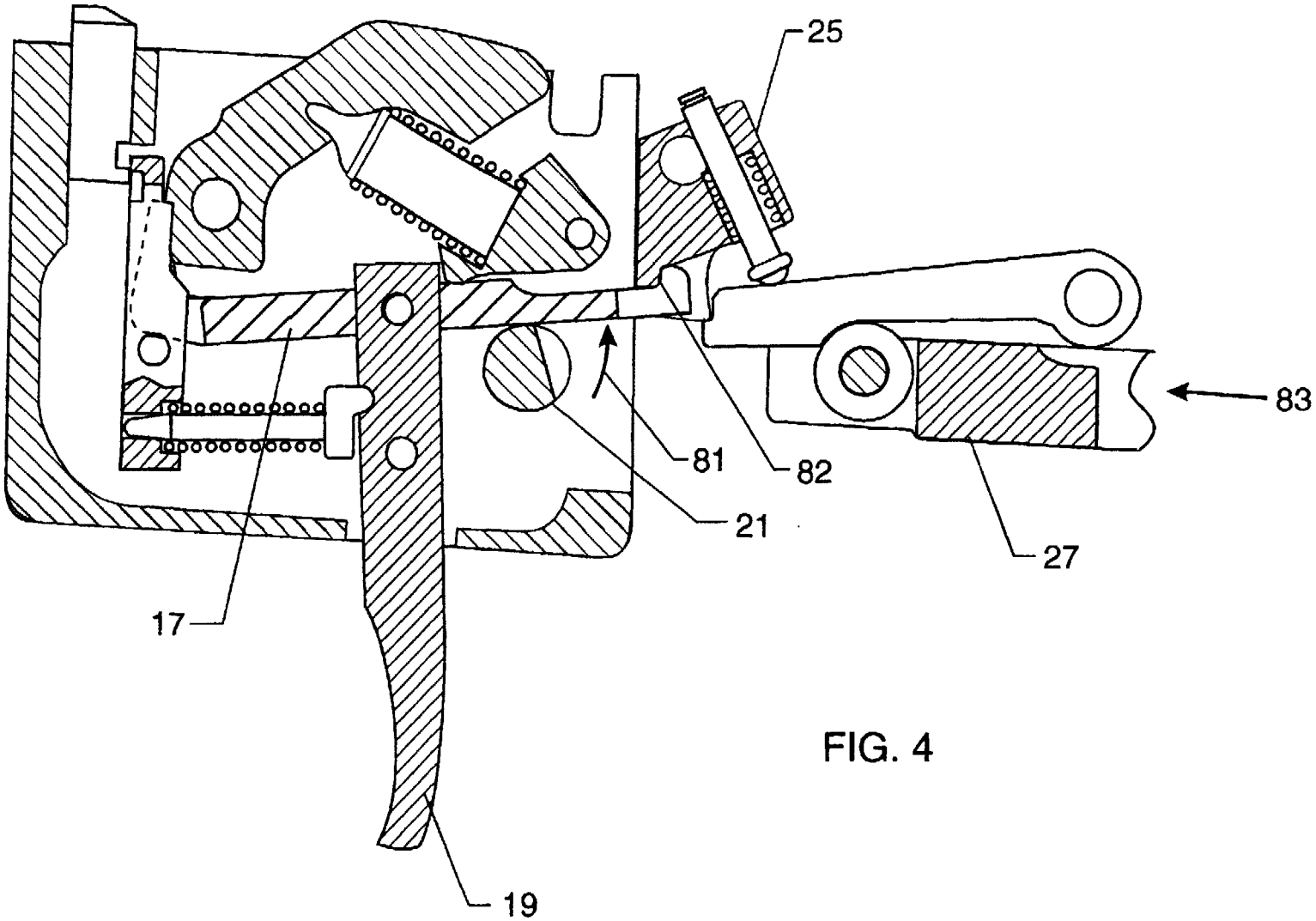
FIG. 4 shows the connector link engaging the secondary sear assembly.

Referring now to FIG. 4, operation of the secondary sear and hammer can be seen where selector bar 21 is rotated, as shown in a clockwise direction. The connector link 17 is forced to rotate in a counterclockwise direction as shown by arrow 81. This rotation causes an engagement with the second sear prop 25 at lug position 82. A spring force, represented by arrow 83, is applied to the secondary hammer 27. The secondary hammer 27 is a plunger or piston type hammer which operates by sliding left and right in this depiction.

Figure 5:
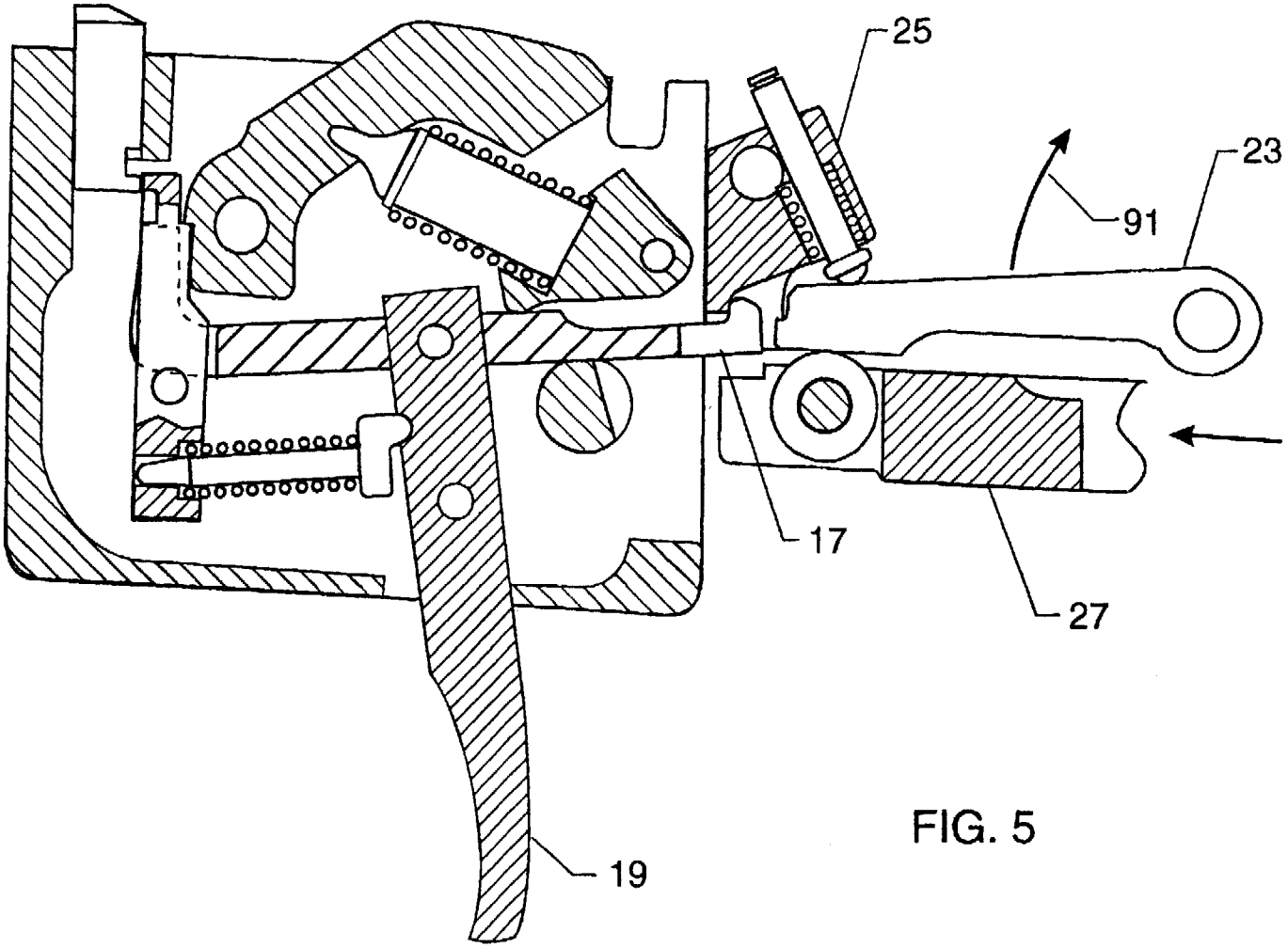
FIG. 5 shows the secondary sear tripped.

Referring now to FIG. 5, with the trigger 19 fully depressed, the sear prop 25 is pulled by the connector link 17 out of contact with the secondary sear 23, thereby allowing the secondary hammer 27 to force the secondary sear 23 to rotate clockwise (depicted by the rotation arrow 91) as it moves to the left.

Figure 6:
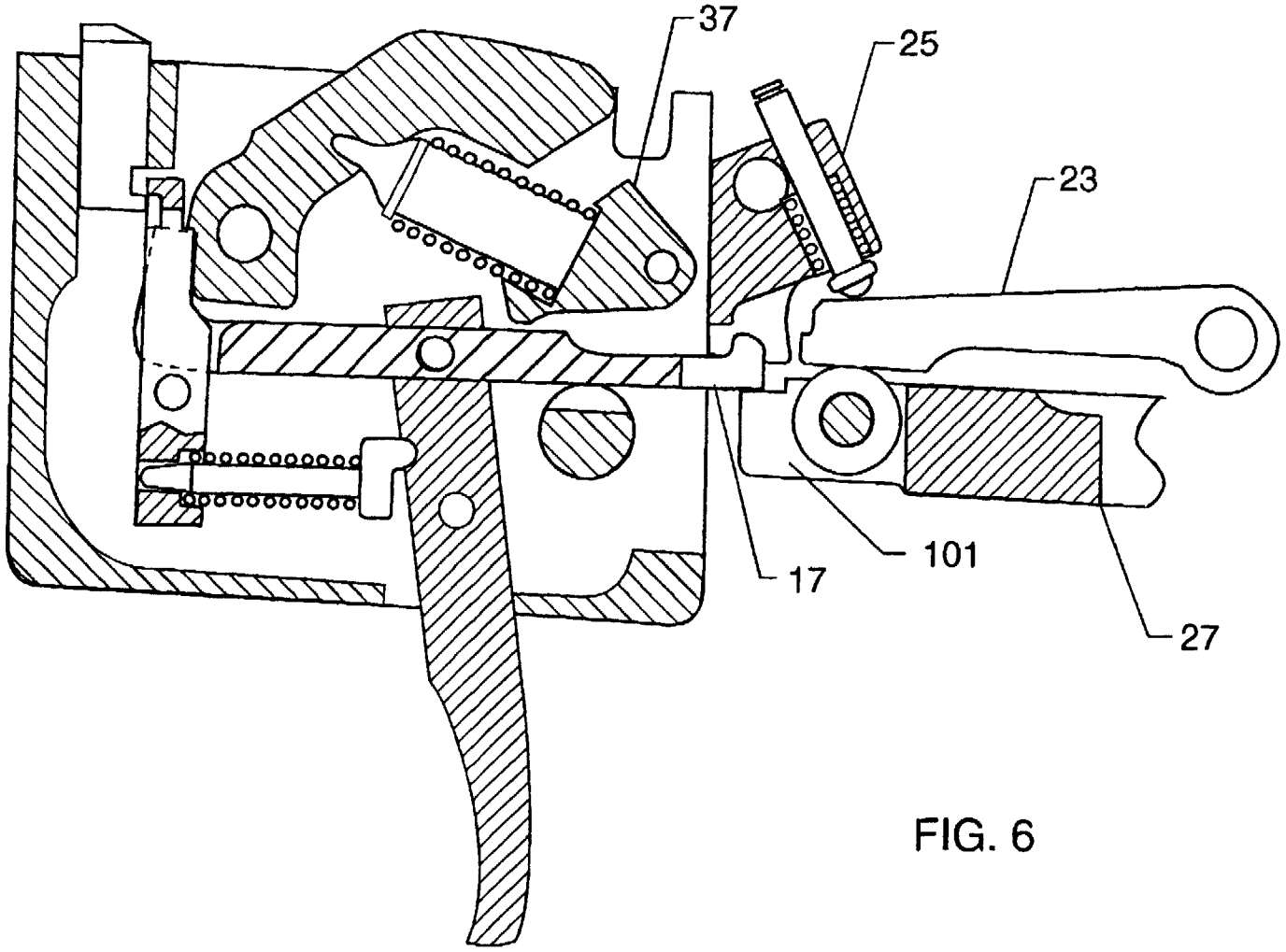
FIG. 6 shows the secondary hammer fully extended and preventing connector link engagement.

Referring now to FIG. 6, the secondary hammer 27 is shown at the extent of its movement. The hammer nose 101 lies in a position to prevent connector link 17 from rotating clockwise under force from the connector link spring lever 37. In this position, the connector link 17 cannot engage either sear mechanisms. Further firing of the spotting rifle after firing the main round is prevented by this sear location.

The benefits and novel features of the invention are numerous. A single trigger operates two separate hammer types necessary for firing either the spotter rifle or the main launcher tube. Selection between the weapons firing is accomplished by a simple depressible thumb selector. The mechanism allows repeated firing of the spotting rifle, but precludes further firing after the main munition is expended (until reloading the main munition).

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A single trigger dual firing mechanism comprising:

a trigger housing frame adapted for attachment to a spotter rifle;

a trigger rotatably mounted within said housing;

a connector link pivotally mounted to said trigger, said trigger having a first lug at a first end for engagement of a primary sear and a second lug at a second end for engagement of a secondary sear;

a selector bar rotatably mounted on said housing frame and engaging said connector link with an eccentric cam section thereby providing a position central of said connector link;

a primary sear pivotally attached to said trigger housing frame and engaging said connector link;

a primary hammer rotatably connected to said trigger housing frame and engaging said primary sear;

a primary hammer spring connected to said hammer on a first end and having a second end for connection to a connector link spring lever;

a connector link spring lever engaging and operated by said primary hammer spring and further engaging said connector link thereby providing a downward impetus to the second end of said connector link and urging said link against the selector bar;

a secondary sear prop rotatably attached to said trigger housing frame and engaging the second end of said connector link;

a secondary sear rotatably outside said housing frame and engaging said sear prop; and a secondary hammer slidably mounted outside said housing and engaging said secondary sear.

2. A single trigger dual firing mechanism comprising:

a trigger assembly having a single trigger;

a means for housing said trigger assembly;

a primary sear connected to said trigger assembly;

a secondary sear connected to said trigger assembly;

a connector link rotatably mounted on the trigger first end with a first engaging lug and a second end with a second engaging lug and further having a selector bar rotatably mounted to said means for housing, said selector bar having a cam section for engaging the connector link;

a rotating hammer assembly engaging said primary sear;

a plunger type sliding hammer engaging said secondary sear.

3. A single trigger dual firing mechanism as in claim 2 wherein said rotating hammer assembly comprises a rotating hammer and a primary hammer spring.

4. A single trigger dual firing mechanism as in claim 3 wherein said connector link spring lever engages and is operated by said primary hammer spring.

5. A single trigger dual firing mechanism comprising:

a trigger assembly;

means for selectively operating a first rotating hammer and a second sliding hammer connected to said trigger assembly; and means for locking out further trigger operation after operating said second hammer.

6. A single trigger dual firing mechanism as in claim 2 wherein said connector link has a spring lever rotatably mounted on said means for housing and said spring urging the second end of said connector link in a downward direction towards said selector bar.

* * * * *

UNITED STATES PATENT AND TRADEMARK OFFICE

Certificate

Patent No. 5,709,046

Patented: January 20, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael M. Canaday and Fred W. Watson, Jr.

Signed and Sealed this Sixth Day of April, 1999.

CHARLES T. JORDAN
*Supervisory Patent Examiner*
Art Unit 3641